US005496235A

United States Patent [19]

Stevens

[11] Patent Number: 5,496,235

[45] Date of Patent: Mar. 5, 1996

[54] WALKING EXERISER

[76] Inventor: Clive G. Stevens, 372 Hills Borough Road, Auckland, New Zealand

[21] Appl. No.: 511,178

[22] Filed: Aug. 4, 1995

[51] Int. Cl.[6] ..... A63B 2200

[52] U.S. Cl. ..... 482/51; 482/52; 434/255

[58] Field of Search ..... 482/51, 52, 53, 482/70, 130, 54, 79, 74, 129, 148

[56] References Cited

U.S. PATENT DOCUMENTS

| | | | |
|---|---|---|---|
| 4,850,585 | 7/1989 | Dalebout | 482/51 |
| 4,861,023 | 8/1989 | Wedman | 482/51 |
| 4,940,233 | 7/1990 | Ball et al. | 482/51 |
| 5,000,443 | 3/1991 | Dalebout et al. | 482/51 |
| 5,299,993 | 4/1994 | Habing | 482/52 |
| 5,419,747 | 5/1995 | Piaget et al. | 482/51 |

OTHER PUBLICATIONS

"New Total Jogger", New York Times, Sep. 7, 1969 p. 29 Shopping Guide.

*Primary Examiner*—Stephen R. Crow

*Attorney, Agent, or Firm*—Pro-Techtor International

[57] ABSTRACT

A walking exerciser includes a frame structure having two board members on two sides and a handle member for a user to grip and two sets of swinging support members pivotally mounted on the board members of the frame structure. Each set of the swinging support members includes two swinging support members the upper ends of which are pivotally mounted on the board member and a step pedal pivotally mounted on the lower ends of the swinging support members. The swinging support members and said step pedal together form a substantially triangular pattern with a distance between the pivots on the upper ends of the swinging support members less than that between the pivots on the lower ends thereof so that the angle of the step pedal can be the most suitable foot angle for the user. Two resistance adjusting devices are disposed between said board members and the upper ends of the swinging support members. By means of tightening/loosening an adjusting knob of each resistance adjusting device, a frictional resistance against the swinging movement of the swinging support members can be adjusted.

3 Claims, 5 Drawing Sheets

WALKING EXERISER

BACKGROUND OF THE INVENTION

The present invention relates to a walking exerciser having a frame structure and two sets of swinging support members pivotally mounted on two sides of the frame structure. A step pedal is pivotally mounted on lower end of each set of the swinging support members, on which a user can more stably step and reciprocally swingingly walk. A resistance adjusting device is attached to each set of the swinging support members, whereby by means of tightening/loosening an adjusting knob of the resistance adjusting device, the resistance against reciprocally swinging movement of the swinging support members is adjustable according to the requirement of the user.

Nowadays, a mechanical exerciser is widely used for training and rehabilitation purposes. Especially, a walking exerciser can be used to exercise the muscle of a user's legs without occupying much room. FIG. 5 shows a conventional walking exerciser comprising a frame structure 1 having a handle member, two sets of swinging support members A pivotally mounted on the frame structure 1 and two step pedals B pivotally connected at lower ends of each set of the swinging support members A. A user can grip the handle member and reciprocally swingingly walk on the step pedals B. The swinging support members A of the conventional walking exerciser are arranged in a rectangular pattern. That is, the pivots on the upper portion of the swinging support members A are equally spaced as the pivots on the step pedal on the lower portion of the swinging support members A. Accordingly, the step pedal will always swing parallel to the floor. This is not the most suitable foot angle for the user. In addition, the gravity centers of the swinging support members A are relatively high and thus the swinging support members A cannot be stably swung. Therefore, a user may fall down during operation of the walking exerciser. This is extremely dangerous to the user, especially to an old-timer.

SUMMARY OF THE INVENTION

It is therefore a primary object of the present invention to provide a walking exerciser in which the swinging support members have a triangular pattern with the upper pivots spaced by a less distance than the lower pivots are spaced so that the angle of the step pedals can be the most suitable foot angle for the user. In addition, the gravity centers of the swinging support members are relatively low, enabling the swinging support members to be more stably swung to ensure safety in use.

It is a further object of the present invention to provide the above walking exerciser in which a resistance adjusting device is disposed between the frame structure and the swinging support members, whereby by means of tightening/loosening an adjusting knob of the adjusting device, the resistance against reciprocally swinging movement of the swinging support is adjustable according to the requirement of the user. This permits the swinging support members to be swung at different speeds suitable for different users. The present invention can be best understood through the following description and accompanying drawing, wherein:

DETAILED DESCRIPTION OF THE PREFERRED EMBODIMENT

Figure 1:
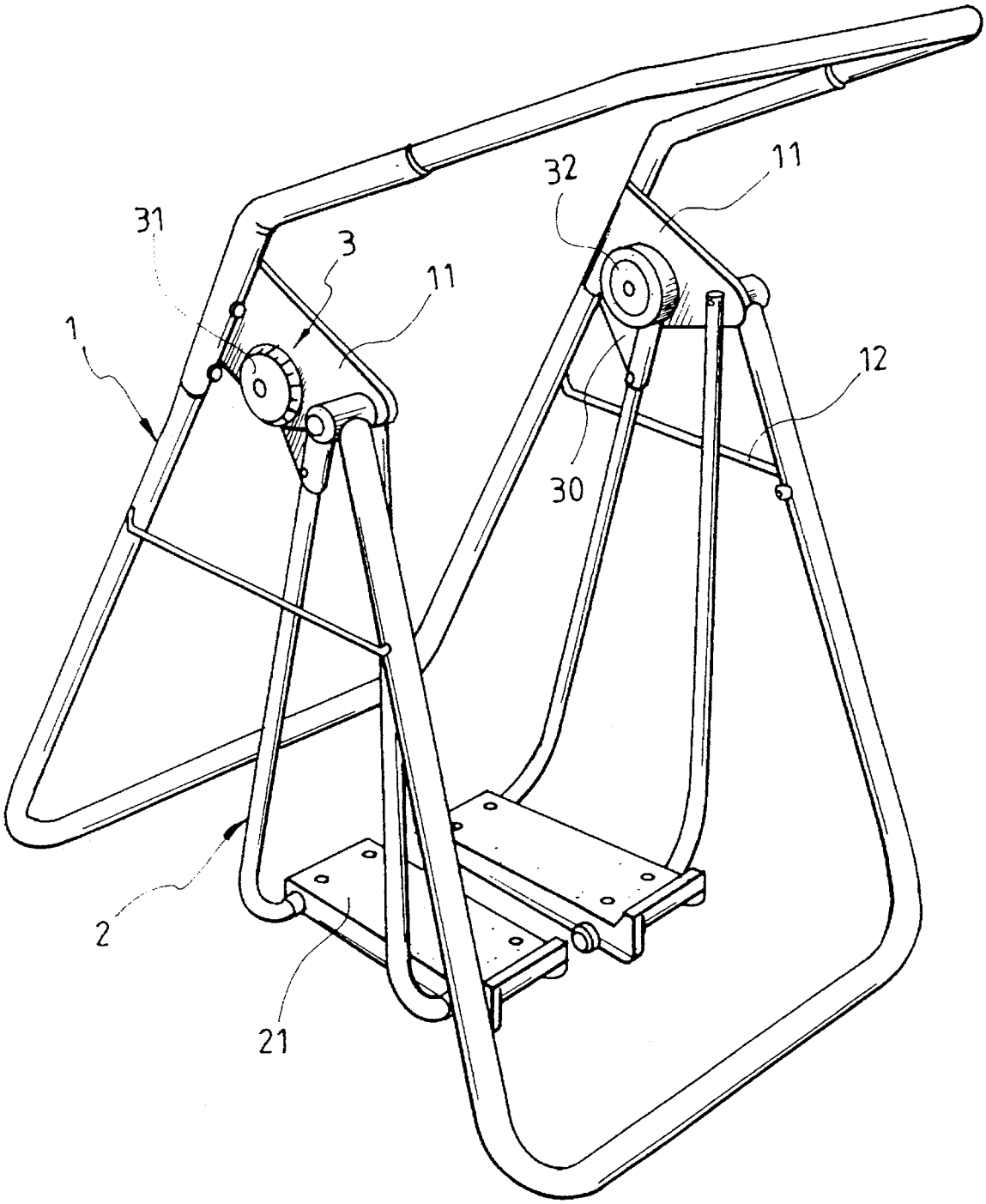
FIG. 1 is a perspective assembled view of the present invention.

Referring to FIG. 1, wherein a walking exerciser of the present invention is shown, the walking exerciser of the present invention comprises a frame structure 1, two sets of swinging support members 2 pivotally mounted on two sides of the frame structure 1 and two resistance adjusting devices 3 disposed between the frame structure 1 and the swinging support members 2.

Figure 4:
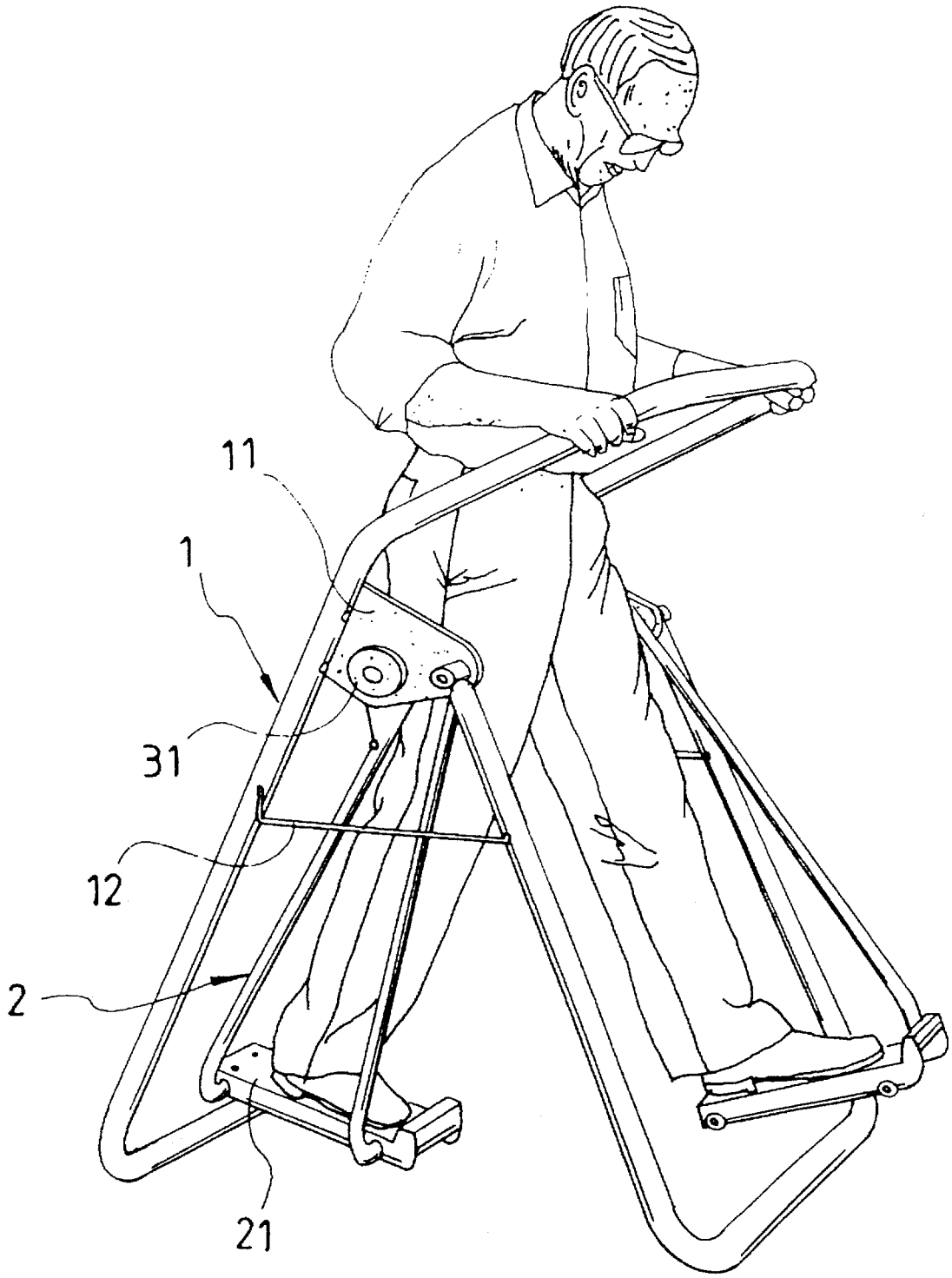
FIG. 4 shows the application of the walking exerciser of the present invention.
Figure 5:
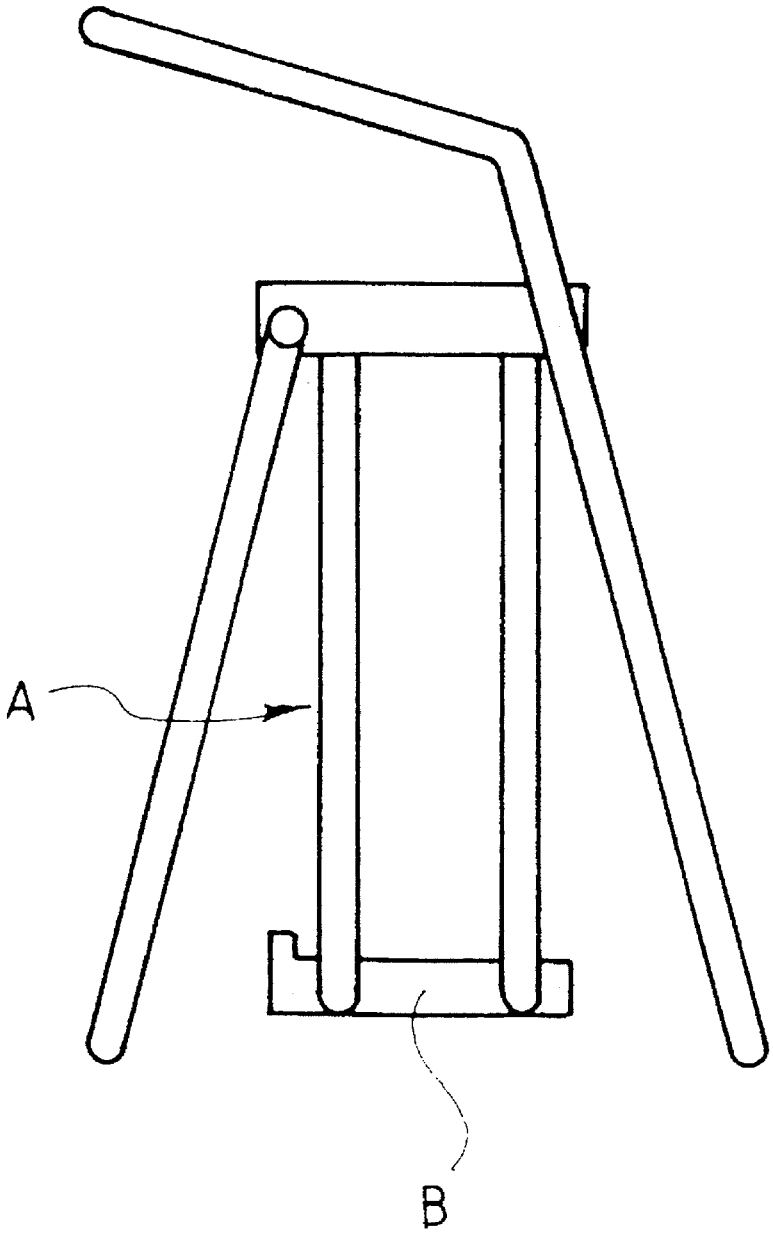
PRIOR ART FIG.5
FIG. 5 is a schematic diagram of the conventional walking exerciser.

The frame structure 1 comprises a first and a second U-shaped tube members and two board members 11 on which the tube members are pivotally disposed. A U-shaped handle member is attached to the first tube member for a user to grip. The first and second tube members can be pivotally stretched outward away from each other to form a triangular pattern so as to stably bear the weight of the user. Two fixing levers 12 are pivotally disposed on two lateral sides of the first tube member, whereby after the two tube members are stretched outward, the fixing levers 12 can be locked between the tube members to prevent the same from further moving outward. Each set of the swinging support members 2 comprises two L-shaped swinging support members pivotally mounted on the frame structure by two pivots on the upper ends of the swinging support members and a step pedal 21 pivotally mounted on the lower ends thereof by two pivots. The swinging support members and the step pedal 21 together form a substantially triangular pattern. That is, the distance between the pivots on the upper ends of the swinging support members is less than that between the pivots on the lower ends thereof. Therefore, during the swinging movement of the swinging support members, the inclined angle of the step pedals can be the most suitable foot angle for the user to safely and stably walk on the step pedals 21 as shown in FIG. 4.

Figure 2:
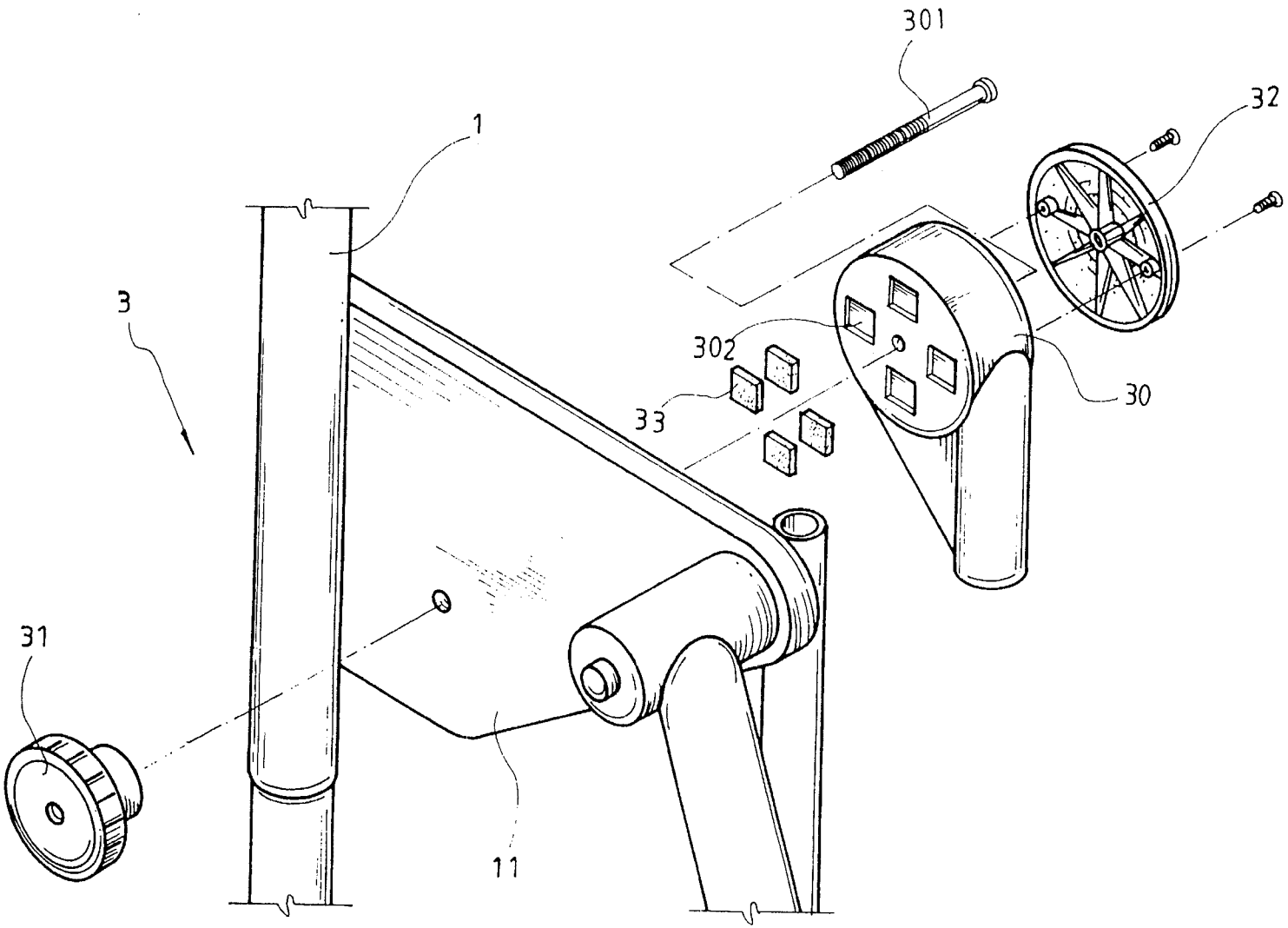
FIG. 2 is a partially exploded perspective view showing the connection between the frame structure, swinging support members and resistance adjusting device of the present invention.
Figure 3:
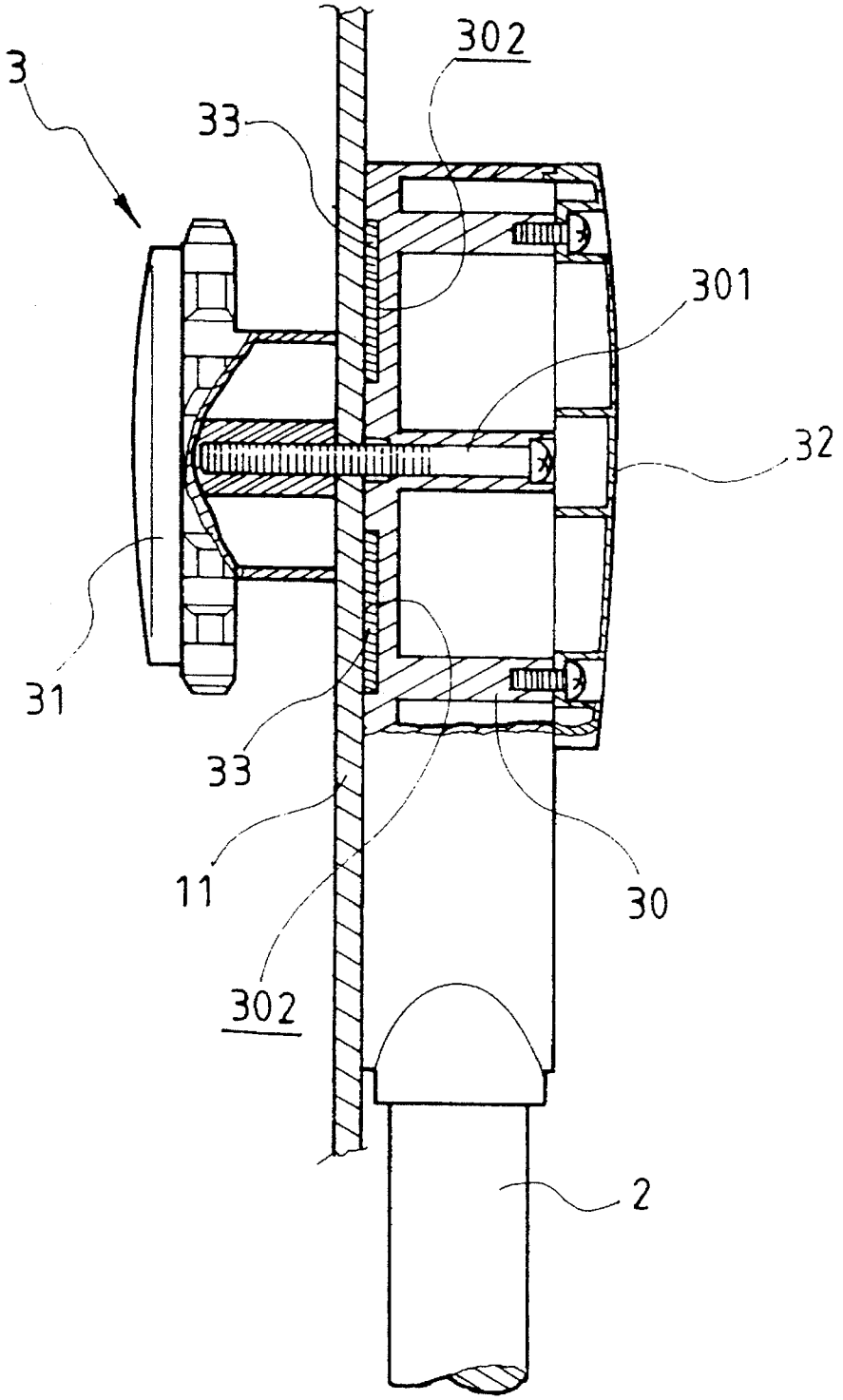
FIG. 3 is a sectional assembled view showing the connection between the frame structure, swinging support members and resistance adjusting device of the present invention.

Referring to FIGS. 2 and 3, the resistance adjusting device 2 is disposed between the upper end of each set of swinging support members 2 and the board member 11 of the frame structure 1. The resistance adjusting device 2 comprises a main body 30 pivotally disposed on the board member 11, a cover member 32 and an adjusting knob 31. The main body 30 is formed with an insertion hole for inserting and fixing the upper end of the swinging support members therein. A thread rod 301 is disposed at a center of the main body 30 and passed through a hole of the board member 11 to connect with the adjusting knob 31. In addition, an inner face of the main body 30 is formed with several recesses 302 for receiving several brake lining plates 33 to contact with the board member 11. By means of tightening/loosening the adjusting knob, the frictional force between the lining plates 33 and the board member 11 can be adjusted so as to adjust the resistance against the swinging movement of the swinging support members 2. That is, when the adjusting knob is tightened, the lining plates 33 are morel tightly clamped between the board member 11 and the recesses 302 so that the swinging support members 2 suffer greater resistance against the swinging movement thereof and can only swing at lower speed, while when the adjusting knob is loosened, the lining plates 33 are less tightly clamped between the board member 11 and the recesses 302 or even only loosely positioned therebetween so that the resistance against the swinging movement of the swinging support members 2 is smaller and the swinging support members 2 can swing at higher speed.

It is to be understood that the above description and drawings are only used for illustrating one embodiment of the present invention, not intended to limit the scope thereof. Any variation and derivation from the above description and drawings should be included in the scope of the present invention.

What is claimed is:

1. A walking exerciser comprising a frame structure having two board members on two sides and a handle member for a user to grip and two sets of swinging support members pivotally mounted on said board members of said frame structure, said exerciser being characterized in that each set of swinging support members includes two swinging support members pivotally mounted on said board members by two pivots on upper ends of the swinging support members and a step pedal pivotally mounted on lower ends of said swinging support members by two pivots on the lower ends of the swinging support members.

2. The walking exerciser as claimed in claim 1, further comprising two resistance adjusting devices disposed between said board members and upper ends of said swinging support members, each said resistance adjusting device comprising a main body pivotally mounted on said board member and an adjusting knob, said main body being fixedly attached to the upper ends of said swinging support members and a thread rod being passed through said main body and said board member to connect with said adjusting knob, several brake lining plates being disposed between said main body and said board member to frictionally contact with said board member so as to create a frictional resistance against swinging movement of said swinging support members, said adjusting knob being able to be tightened/loosened to adjust said frictional resistance.

3. The walking exerciser as claimed in claim 1, further comprising two resistance adjusting devices disposed between said board members and upper ends of said swinging support members, each said resistance adjusting device comprising a main body pivotally mounted on said board member and an adjusting knob, said main body being fixedly attached to the upper ends of said swinging support members and a thread rod being passed through said main body and said board member to connect with said adjusting knob, several brake lining plates being disposed between said main body and said board member to frictionally contact with said board member so as to create a frictional resistance against swinging movement of said swinging support members, said adjusting knob being able to be tightened/loosened to adjust said frictional resistance.

* * * * *

UNITED STATES PATENT AND TRADEMARK OFFICE

CERTIFICATE OF CORRECTION

PATENT NO. : 5,496,235

DATED : MAR. 5, 1996

INVENTOR(S) : Clive G. Stevens

It is certified that error appears in the above-identified patent and that said Letters Patent is hereby corrected as shown below:

Claim 1, column 3, line 28, after "members" insert -- ; wherein said swinging support members and said step pedal together form a substantially triangular pattern with a distance between said pivots on the upper ends of said swinging support members less than between said pivots on the lower ends thereof --

Signed and Sealed this

Twenty-fifth Day of March, 1997

*Attest:*

Bruce Lehman

BRUCE LEHMAN

*Attesting Officer*

*Commissioner of Patents and Trademarks*